United States Patent [19]

Lloyd et al.

[11] 3,980,539

[45] Sept. 14, 1976

[54] PROCESS FOR ELECTROLYTIC GRAINING OF ALUMINUM

[75] Inventors: Mark C. Lloyd, Harrow; Stuart C. Parish, Ruislip, both of England

[73] Assignee: Eastman Kodak Company, Rochester, N.Y.

[22] Filed: July 30, 1975

[21] Appl. No.: 600,668

[30] Foreign Application Priority Data

Aug. 7, 1974 United Kingdom ..... 34844/74

[52] U.S. Cl. ..... 204/129.75; 204/129.1

[51] Int. Cl.[2] ..... C25F 3/02; C25F 3/04

[58] Field of Search ..... 204/33, 129.75, 129.85, 204/140, 129.1, 129.35, 129.8, 129.4

[56] References Cited

UNITED STATES PATENTS

| | | | |
|---|---|---|---|
| 3,072,546 | 1/1963 | Wruck | 204/33 |
| 3,073,765 | 1/1963 | Adams | 204/33 |
| 3,085,950 | 4/1963 | Thomas | 204/129.75 |

FOREIGN PATENTS OR APPLICATIONS

| | | | |
|---|---|---|---|
| 2,110,257 | 2/1972 | France | 204/129.75 |
| 41-6249 | 4/1966 | Japan | 204/129.75 |

*Primary Examiner*—T. M. Tufariello
*Attorney, Agent, or Firm*—A. P. Lorenzo

[57] ABSTRACT

Aluminum is electrolytically grained in an aqueous electrolyte solution containing both hydrochloric acid and boric acid. The hydrochloric acid and boric acid are employed in concentrations which provide grained aluminum that is substantially free of pits, even when high electrolytic current densities are employed in order to complete the graining in a short period of time. Aluminum grained by this process is especially useful as a support for lithographic printing plates.

3 Claims, No Drawings

PROCESS FOR ELECTROLYTIC GRAINING OF ALUMINUM

This invention relates in general to the graining of aluminum and in particular to an improved process for the electrolytic graining of aluminum which permits the graining to be carried out in a rapid manner without the formation of pits.

It has long been known to carry out electrolytic graining of aluminum and the electrolytic process has many advantages over mechanical graining. (See, for example, U.S. Pat. Nos. 3,072,546 and 3,073,765). For certain applications, a very fine and even grain is desired. For example, when the aluminum is to be used as a support for lithographic printing plates such characteristics are especially advantageous. A fine and even grain can be obtained in an electrolyte consisting of an aqueous solution of hydrochloric acid but the current density employed must be kept quite low or pitting of the aluminum surface will take place and, as a result of the low current density, it requires a relatively long period to complete the graining. French Pat. No. 2,110,257 describes a process for electrolytic graining of aluminum in which the graining is carried out at a current density of 0.5 to 10 A/dm$^2$ (amperes per square decimeter) in an aqueous electrolyte solution containing 0.5 to 2 percent by weight of hydrochloric acid and 0.1 to 1.5 percent by weight of boric acid. This process provides a fine and even grain but it is relatively slow with the time required for graining typically being about 5 minutes, or longer. According to this patent, the use of concentrations of hydrochloric acid or boric acid above 2 percent, or the use of a current density exceeding 10 A/dm$^2$, yields a coarse and irregular surface that is not suitable for use in lithographic printing.

Contrary to the teachings of French Pat. No. 2,110,257, it has now been discovered that a fine and even grain that is substantially free of pits can be obtained with a current density greater than 10 A/dm$^2$ provided the hydrochloric acid and boric acid are employed in an appropriate concentration, as hereinafter described. Thus, the process of this invention comprises electrolytically graining aluminum in an aqueous electrolyte solution containing hydrochloric acid and boric acid with an electrolytic current density greater than 10 A/dm$^2$ and with concentrations of hydrochloric acid and boric acid sufficient that a fine even grain that is substantially free from pits is obtained. The optimum concentrations of the hydrochloric acid and boric acid will depend upon such factors as the exact current density employed, the temperature of the electrolyte solution, the properties of the aluminum article being grained, and so forth, and can be readily determined by a few simple experiments.

In the process of this invention, the electrolytic current density employed is greater than 10 A/dm$^2$ and it is especially advantageous that it be at least 15 A/dm$^2$. Preferably, the electrolytic current density is in the range from 15 A/dm$^2$ to 40 A/dm$^2$, and most preferably in the range from 15 A/dm$^2$ to 30 A/dm$^2$.

Concentrations of hydrochloric acid and boric acid used in the process of this invention can be any concentrations that will provide a fine even grain that is substantially free of pits when using a current density greater than 10 A/dm$^2$. It has been found that concentrations of boric acid of at least about 1.5 percent by weight, preferably in the range of from about 1.5 to 4 percent by weight, and most preferably in the range of from about 1.5 to 3 percent by weight, and concentrations of hydrochloric acid of at least about 2 percent by volume of concentrated hydrochloric acid, and preferably in the range of from about 2 to 2.5 percent by volume, are especially advantageous. Concentrated hydrochloric acid is here defined as an aqueous solution containing at least 35.4% HCl by weight.

The temperature at which the electrolytic graining is carried out is not critical but preferably should not exceed 35°C. Use of room temperature gives fully satisfactory results and is ordinarily preferred.

As a result of the relatively high current densities employed in the process of this invention, the graining is completed in a very rapid manner and this is an important advantage as compared with prior art processes such as that described in French Pat. No. 2,110,257. Ninety seconds is ordinarily a sufficient time for the graining to be completed in the process of this invention and under conditions involving the use of very high current densities the graining can be completed much more rapidly, such as in a time of as little as about 10 seconds.

The electrolytic graining process of this invention can be carried out in a batch, semi-continuous or continuous manner. The aluminum can be in the form of shaped objects, including sheets or foils, and can be grained in the form of a continuous web by adapting the process to continuous operation. As used herein, the term "aluminum" is intended to refer to both pure aluminum and alloys of aluminum which are capable of being grained electrolytically.

The invention is further illustrated by the following examples:

EXAMPLE 1

A. A piece of aluminum alloy foil 0.2 mm thick and measuring 1 dm$^2$ was immersed in a 12% w/v solution of sodium hydroxide for 1.5 minutes at room temperature to remove mill oil and to prepare the surface for graining. The composition of the aluminum alloy was as follows:

| | |
|---|---|
| Manganese | 1–1.5 % |
| Copper | 0.1% maximum |
| Silicon | 0.6% maximum |
| Iron | 0.7% maximum |
| Zinc | 0.2% maximum |
| Titanium | 0.2% maximum |
| Aluminum | balance of composition |

The foil was washed and then immersed in an electrolytic bath containing 1.5% by volume of concentrated hydrochloric acid and 1% by weight of boric acid in deionized water. An alternating current at 50 Hz and a density of 4 A/dm$^2$ was passed from the foil through the electrolyte to an aluminum counter-electrode for 5 minutes. Only one side of the foil was grained, the back being protected by the masking effect of the adjacent wall of the electrolytic tank. The foil was then rinsed in water and given a further 30 second treatment in the sodium hydroxide solution followed by washing and drying. A fine even grain was produced on the foil surface by this prior art treatment.

B. A second piece of the same aluminum foil was treated as in (A) except that the alternating current density was 30 A/dm$^2$ and the foil was grained for only 30 seconds. After completion of the treatment the foil looked superficially similar to that of (A). However, on microscopic examination it was found to be covered with a large number of shallow pits that rendered it unsuitable for use as a base material for lithographic printing.

C. A third piece of the same aluminum foil was treated as in (B) but in an electrolyte containing 2% by volume of concentrated hydrochloric acid and 2% by weight of boric acid. On completion of the treatment the grained foil was found to be free from pits and was a good match for the foil treated in (A).

EXAMPLE 2

The procedure of Example 1 was followed using an electrolytic bath containing 2.5% by volume concentrated hydrochloric acid and 4% by weight boric acid. The graining treatment was carried out at 40 A/dm$^2$ for 30 seconds which caused the temperature of the electrolyte to rise somewhat. A very fine grain free from pits was produced.

EXAMPLE 3

The procedure of Example 1 was followed using an electrolytic bath containing 2% by volume concentrated hydrochloric acid and 1.5% by weight boric acid.

The graining treatment was carried out at 10 A/dm$^2$ for 1.5 minutes giving an even grain free of pits.

The invention has been described in detail with particular reference to preferred embodiments thereof, but it will be understood that variations and modifications can be effected within the spirit and scope of the invention.

What is claimed is:

1. In a process for electrolytically graining aluminum in an aqueous electrolyte solution containing hydrochloric acid and boric acid, the improvement wherein the electrolytic current density is greater than 10 A/dm$^2$ and up to 40 A/dm$^2$, the concentration of hydrochloric acid is 2 to 2.5% by volume, and the concentration of boric acid is 1.5 to 4% by weight, whereby a fine even grain that is substantially free from pits is obtained.

2. The process of claim 1 wherein the electrolytic current density is in the range from 15 to 30 A/dm$^2$.

3. The process of claim 1 wherein the graining is carried out at room temperature for a period of about 30 seconds with a current density of 30 A/dm$^2$, a concentration of hydrochloric acid of 2% by volume, and a concentration of boric acid of 2% by weight.

* * * * *